US007633448B2

(12) United States Patent
Su et al.

(10) Patent No.: US 7,633,448 B2
(45) Date of Patent: Dec. 15, 2009

(54) MULTI-BAND ANTENNA ASSEMBLY

(75) Inventors: Wen-Fong Su, Tu-Cheng (TW); Yao-Shien Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 112 days.

(21) Appl. No.: 11/799,514

(22) Filed: May 1, 2007

(65) Prior Publication Data

US 2007/0257847 A1 Nov. 8, 2007

(30) Foreign Application Priority Data

May 2, 2006 (TW) ..... 95207457 U

(51) Int. Cl.
*H01Q 1/24* (2006.01)

(52) U.S. Cl. ..... 343/702; 343/700 MS; 343/846

(58) Field of Classification Search ..... 343/700 MS, 343/702, 829, 846
See application file for complete search history.

(56) References Cited

U.S. PATENT DOCUMENTS 6,429,818 B1 * 8/2002 Johnson et al. ..... 343/702
6,734,825 B1 * 5/2004 Guo et al. ..... 343/700 MS
7,196,665 B2 * 3/2007 Koshi et al. ..... 343/700 MS
7,324,054 B2 * 1/2008 Ozkar ..... 343/702

* cited by examiner

*Primary Examiner*—Tho G Phan
(74) *Attorney, Agent, or Firm*—Wei Te Chung; Andrew C. Cheng; Ming Chieh Chang

(57) ABSTRACT

A multi-band antenna assembly, comprising: a first antenna used for wireless local area network and comprising a first radiating element comprising a high frequency radiating portion and a low frequency radiating portion, and a first grounding element adapted for assembling said first antenna on an electric device; a second antenna used for wireless wide area network and comprising a second radiating element comprising a high frequency radiating portion and a low frequency radiating portion, and a second grounding element adapted for assembling said second antenna on an electric device; wherein said first antenna and said second antenna independent from each other; said grounding elements of said two antennas comprising two main bodies substantially aligned with each other, said first and second radiating elements of said first antenna and said second antenna locating on the same side of said first and second grounding elements, said low frequency radiating portions of said first antenna and said second antenna extend more than directions.

15 Claims, 4 Drawing Sheets

MULTI-BAND ANTENNA ASSEMBLY

BACKGROUND OF THE INVENTION

1. Field of the Invention

The present invention relates generally to a multi-band antenna assembly, and more particularly to a multi-band antenna assembly used in electric devices such as notebook, and used for both Wireless Local Area Network (WLAN) and Wireless Wide Area Network (WWAN).

2. Description of the Prior Art

As communication technology is increasingly improved, the weight, volume, cost, performance, and complexity of a communication system also become more important, so antennas that transmit and receive signals in a wireless communication system especially 'draw designers' attention. In a wireless local area network (WLAN), because the space for setting up an antenna is limited and the antenna should transmit a large amount of data, the antenna should be carefully designed. In addition, to meet the requirement of compact size, the antenna is needed to be able to transmit signals of all WLAN bands, including 802.11b (2.4 GHz) and 802.11a (5.2 GHz).

Referring now to FIG. 1, a multi-band antenna 10 is shown and includes a first antenna 11 (WLAN), a second antenna 12 (WWAN), and a grounding element 13 used by the first antenna 11 and the second antenna 12 commonly. The multi-band antenna 10 is a combination of the WLAN antenna and the WWAN antenna together to save space. However, the first antenna 11 of the multi-band antenna 10 is integrated with the second antenna 12 to form a whole. So this multi-band antenna 10 is inconvenient to replace one of the first antenna 11 and the second antenna 12 which is useless. Antennas 11,12 are broken, it must exchange the whole antenna 10, which is wastely and inconvenient.

Hence, an improved multi-band antenna assembly is desired to overcome the above-mentioned shortcomings of the existing antennas.

BRIEF SUMMARY OF THE INVENTION

A primary object, therefore, of the present invention is to provide a multi-band antenna assembly having a WLAN antenna and a WWAN antenna independent from the WLAN antenna, thus, the advantage of the multi-band antenna assembly is of saving space and moving or exchanging one of the two antennas conveniently and sparely forming the multi-band antenna assembly.

In order to implement the above object and overcomes the above-identified deficiencies in the prior art, A multi-band antenna assembly, comprising: a first antenna used for wireless local area network and comprising a first radiating element comprising a high frequency radiating portion and a low frequency radiating portion, and a first grounding element adapted for assembling said first antenna on an electric device; a second antenna used for wireless wide area network and comprising a second radiating element comprising a high frequency radiating portion and a low frequency radiating portion, and a second grounding element adapted for assembling said second antenna on an electric device; wherein said first antenna and said second antenna independent from each other; said grounding elements of said two antennas comprising two main bodies substantially aligned with each other, said first and second radiating elements of said first antenna and said second antenna locating on the same side of said first and second grounding elements, said low frequency radiating portions of said first antenna and said second antenna extend more than directions.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to the three preferred embodiments of the present invention.

Figure 1:
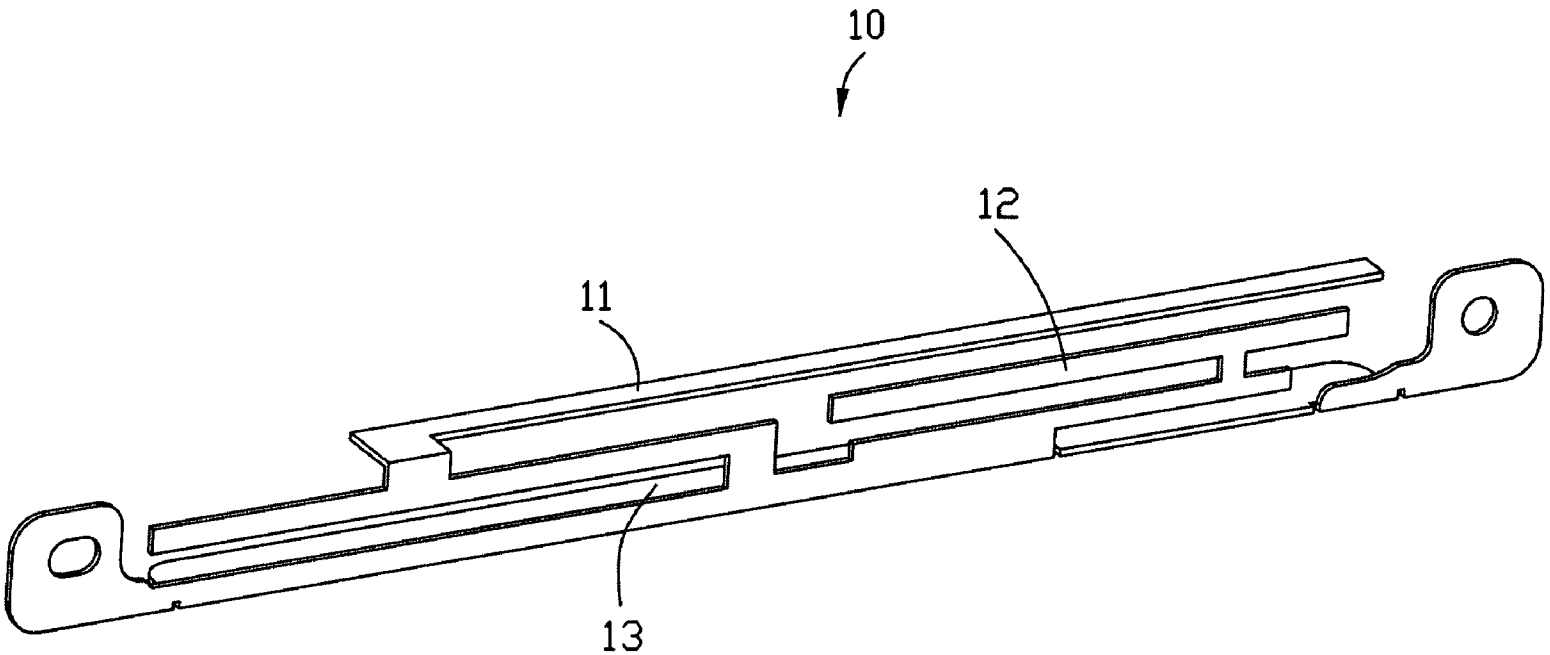
FIG. 1 (PRIOR ART)
FIG. 1 is a plan view illustrating a conventional multi-band antenna.
Figure 2:
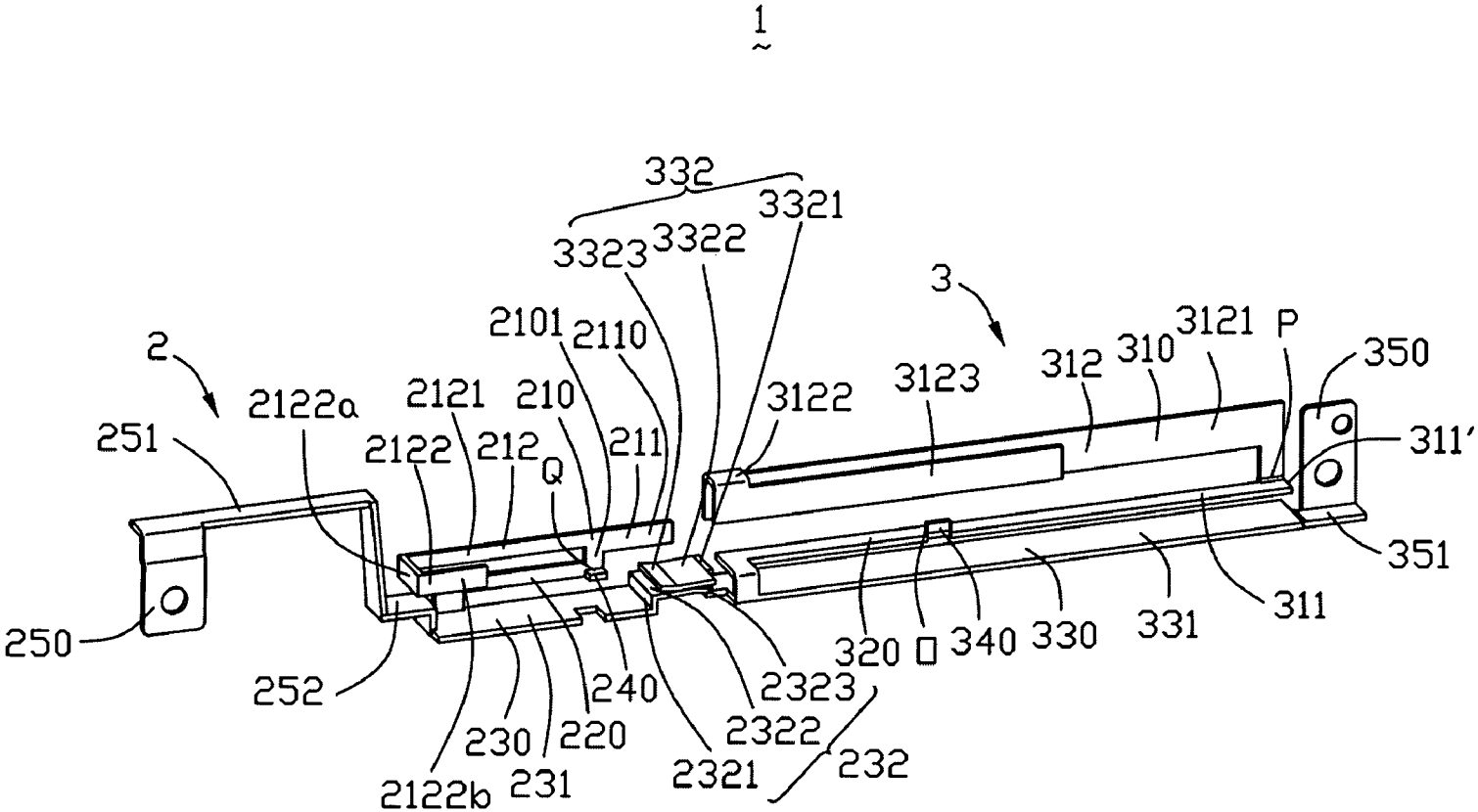
FIG. 2 is a perspective view of a multi-band antenna assembly according to a first preferred embodiment of the present invention.

FIG. 2 illustrates a first preferred embodiment of a multi-band antenna assembly 1 of the invention. The multi-band antenna assembly 1 comprises a first antenna 2 working at WLAN and a second antenna 3 working at WWAN.

The first antenna 2 comprises a first radiating element 210 located in a vertical plane, a first grounding element 230 located in a horizontal plane, a first connecting element 220 extending between the first radiating element 210 and the first grounding element 230, and a protrusion 240 extending from the joint of the first radiating element 210 and the first connecting element 220 and parallel to the first grounding element 230. The first connecting element 220 is L shape. The first radiating element 210 comprises a first radiating portion 211 and a second radiating portion 212 with a common radiating arm 2101. The first radiating portion 211 comprises a first radiating arm 2110, a second radiating portion 212 forming a second radiating arm 2121 and an L-shape metal arm 2122. The first connecting element 220, the first radiating portion 211 and the second radiating arm 2121 are in the same plane A. The L-shape metal arm 2122 extends from the second radiating arm 2121 perpendicular to the second radiating arm 2121 to form a first side arm 2122*a* perpendicular to plane A and a second side arm 2122*b* parallel to the plane A. The first grounding element 230 comprises a main body 231, a setting portion 250 locating on one side thereof and a free end locating on the other side thereof. The free end has an L-shape metal patch 232, and it comprises a side arm 2321 extending from the main body 231 and perpendicular to the main body 231, and a side arm 2322 extending from the side arm 2321 in a parallel direction to the main body 231. The side 2322 has an end with a turndown piece. The setting portion 250 connects with the main body 231 of the first grounding element 230 by two L-shape metal patches 251, 252 interconnecting each other. An aperture is defined in the setting portion 250, which fastens the first antenna 2 to an electric device by a screw threading through the aperture. The protrusion 240 extends from the joint point Q of the first radiating element 210 and the first connecting element 220 and is used to connect with a feed line (not shown).

The second antenna 3 comprises a second radiating element 310, a second grounding element 330, a connecting element 320 extending between the radiating element 310 and the grounding element 330, and a protrusion 340 extending upwardly from the joint of the radiating element 310 and the connecting element 320. The radiating element 310 comprises a flat first radiating portion 311 forming a free end 311' and a second radiating portion 312. The radiating portion 312 connects with the first radiating portion 311 on the joint point P. The radiating portion 312 comprises an L-shape metal patch 3121, two metal patches 3122, 3123. The metal patch 3121 extends from one side of the end of the first radiating portion 311 and is perpendicular to the first radiating portion 311, and the two metal patches 3122, 3123. The grounding element 330 comprises a main body 331, a setting portion 350 locating on one side thereof and a free end 332 locating on the other side thereof. The free end 332 is L shape, and comprises a side arm 3321 extending from the main body 331 and perpendicular to the main body 331, and a flat section 3322 extending from the side arm 3321 and perpendicular to the main body 331. The flat section 3322 has an end with a turnup piece 3323. The setting portion 350 connects with the main body 331 of the grounding element 330 by an L-shape metal patch 351. An aperture is on the setting portion 350, which fastens the second antenna 3 to the electric device by a screw threading through the aperture. The protrusion 340 extends upwardly from the joint point O of the radiating element 310 and the connecting element 320 and is used to connect with a feed line (not shown). The feed line comprises an inner conductor connecting with the protrusion 340 and an outer conductor connecting with the grounding point defined on the second grounding element 330.

The setting portion 250 of the first antenna 2 and the setting portion 350 of the second antenna 3 are respectively on the opposite outmost sides of the multi-band antenna assembly 1. While the free ends (L-shape metal patch) of the two antennas 2, 3 are respectively on the inner sides of each antenna 2, 3 opposite to the outmost sides of the setting portions 250, 350. The side arm 2322 of the L-shape metal patch 232 faces the flat section 3322 of the L-shape metal patch 332. The side arm 2322 nestles up the flat section 3322 but not be conjoined, so whichever of the two antennas 2, 3 can be exchanged in need.

The first antenna 2 is worked in the wireless local area network. The first radiating portion 211 operates at a high frequency band (5 GHz) and the second radiating portion 212 operates at a low frequency band (2.4 GHz). The second antenna 3 is worked in the wireless wide area network. The first radiating potion 311 operates at a high frequency band (1800-1900 MHz) and the second radiating portion 312 operates at a low frequency band (900 MGHz). Both of the second radiating portion 212 of the first antenna 2 and the second radiating portion 312 of the second antenna 3 are low frequency radiating portion, and both of them are designed to have a folded potion for they are long, while the antennas 2, 3 need to keep compact size. For this design, the antennas 2, 3 have reduced size as well as have a good RF performance.

Figure 3:
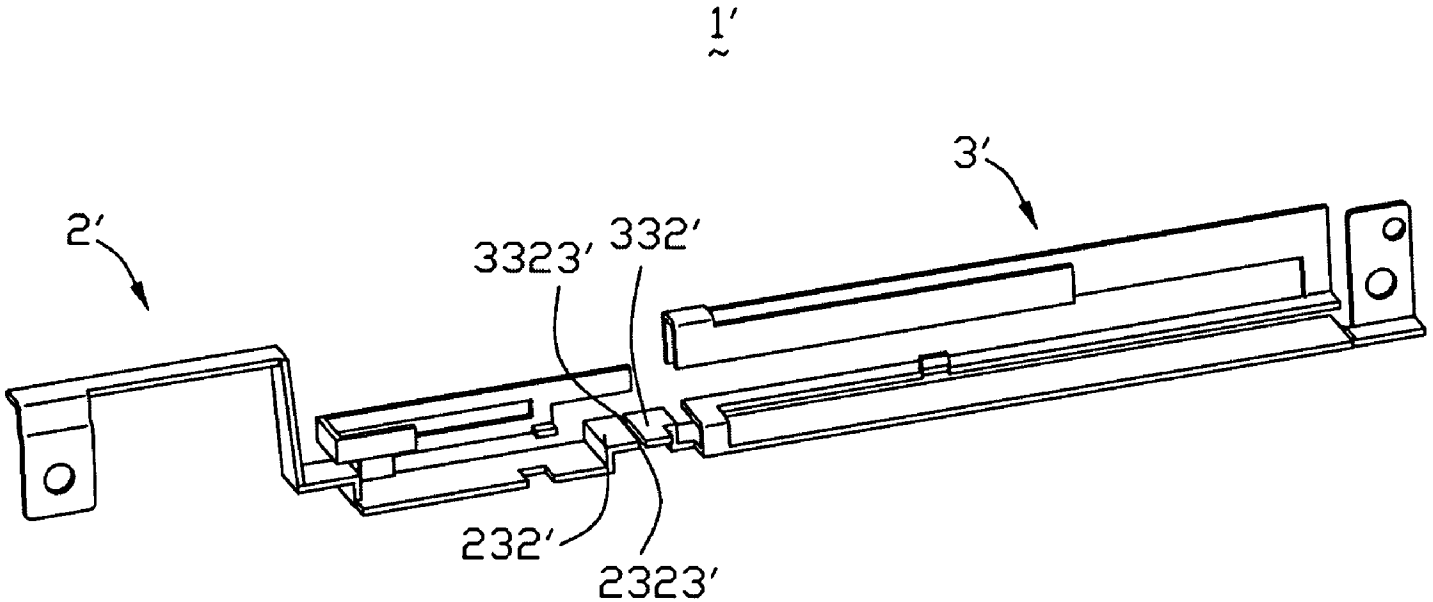
FIG. 3 is a perspective view of a multi-band antenna assembly according to a second preferred embodiment of the present invention.

FIG. 3 illustrates a second preferred embodiment of the multi-band antenna assembly 1' which has a construction similar to the multi-band antenna assembly 1 shown in FIG. 2, except that the relative position of the two grounding elements is different. The multi-band antenna assembly 1' comprises a first antenna 2' and a second antenna 3'. The end edge 2323' of the L-shape metal patch 232' formed on the first antenna 2' faces to the end edge 3323' of the L-shape metal patch 332' formed on the second antenna 3'. In addition, the end edge 2323' of the L-shape metal patch 232' is aligned with the end edge 3323' of the L-shape metal patch 332' with a gap is formed between the two end edges 2323', 3323'.

Figure 4:
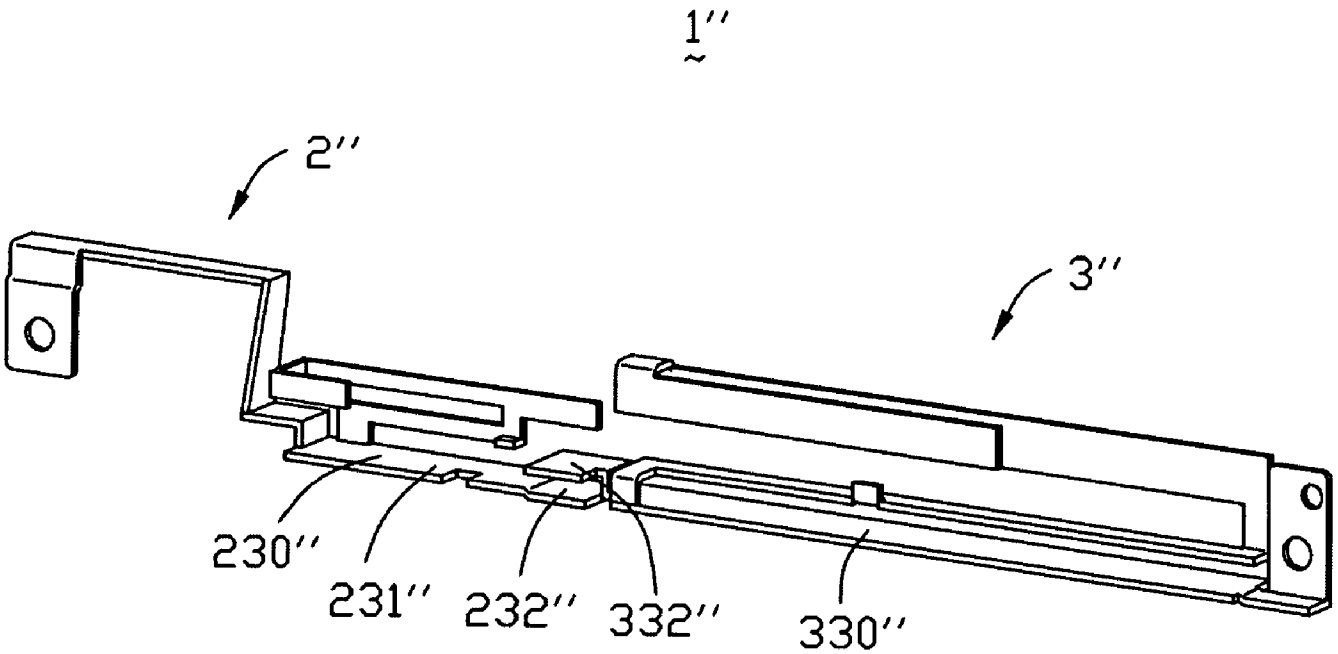
FIG. 4 is a perspective view of a multi-band antenna assembly according to a third preferred embodiment of the present invention.

FIG. 4 illustrates a third preferred embodiment of the multi-band antenna assembly 1" which has a construction similar to the multi-band antenna assembly 1 shown in FIG. 2, except that the relative position of the two grounding elements is different. The multi-band antenna assembly 1" comprises a first antenna 2" and a second antenna 3". The first antenna 2 has an L-shape metal patch, while the first antenna 2" doesn't comprise the L-shape metal patch. The first grounding element 230" of the first antenna 2" has a main body 231" and a metal patch 232" extending from the main body 231". The metal patch 232" is parallel to the L-shape metal patch 332" of the second antenna 3" and located below the L-shape metal patch 332" of the second antenna 3" to form a relative large gap therebetween along vertical direction.

The present invention not only has the three embodiments. Each antenna of the multi-band antenna assembly of the present invention is assembled on the electric device through the setting portion thereof respectively, and the free end of each one could be combined together by a plastic. The grounding element of the multi-band antenna assembly can be designed in the need of the volume of the electric device. The present invention is not only the assembled manner for two single antennas but also fit for the assemblage of multi antennas, and can be changed the structure of the grounding element in need.

What is claimed is:

1. A multi-band antenna assembly, comprising:

a first antenna used for wireless local area network and comprising a first radiating element comprising a high frequency radiating portion and a low frequency radiating portion, and a first grounding element adapted for assembling said first antenna on an electric device; and a second antenna used for wireless wide area network and comprising a second radiating element comprising a high frequency radiating portion and a low frequency radiating portion, and a second grounding element adapted for assembling said second antenna on said electric device;

wherein said first antenna and said second antenna independent from each other; said grounding elements of said two antennas comprising two main bodies substantially aligned with each other, said first and second radiating elements of said first antenna and said second antenna locating on the same side of said first and second grounding elements, said low frequency radiating portions of said first antenna and said second antenna extend more than one directions.

2. The multi-band antenna assembly as claimed in claim 1, wherein each said main body of said first antenna and said second antenna has a setting portion extending from one end of said body and a free end on the other end of said main body, and wherein said setting portions of the first and second antennas are respectively on the outmost sides of said multi-band antenna assembly and said free ends locate on the inner sides of said multi-band antenna assembly.

3. The multi-band antenna assembly as claimed in claim 2, wherein said free ends of said grounding elements of said first antenna and said second antenna faces to each other.

4. The multi-band antenna assembly as claimed in claim 2, wherein said grounding elements of said first antenna and said second antenna both have a free end edge, said two free end edges of said grounding element are aligned with each other along a parallel direction with a gap formed between end edges thereof.

5. The multi-band antenna assembly as claimed in claim 2, wherein one of said free ends of said pounding elements of said first antenna and said second antenna is located below the other one to form a relative large gap therebetween.

6. The multi-band antenna assembly as claimed in claim 1, wherein said first antenna comprises a first radiating portion served as said high frequency radiating portion corresponding to a frequency band at 5 GHZ and a second radiating portion served as said low frequency radiating portion corresponding to a frequency band at 2.4 GHz.

7. The multi-band antenna assembly as claimed in claim 1, wherein said second antenna comprises a first radiating portion served as said high frequency radiating portion corresponding to a frequency band at 1800-1900 MHz and a second radiating portion sewed as said low frequency radiating portion corresponding to a frequency band at 900 MHz.

8. The multi-band antenna assembly as claimed in claim 1, wherein said first antenna comprises a first radiating portion served as said high frequency radiating portion, a second radiating portion served as said low frequency radiating portion and having a common radiating arm with a first radiating portion, and a connecting element.

9. The multi-band antenna assembly as claimed in claim 8, wherein said first radiating portion comprises a first radiating arm and said second radiating portion comprises a second radiating arm extending from said first radiating portion aligned with said first radiating arm and an L-shape metal arm extending on a different plane from said second radiating arm.

10. The multi-band antenna assembly as claimed in claim 9, wherein said first radiating portion, said second radiating arm and said connecting element are located in the same plane.

11. The multi-band antenna assembly as claimed in claim 9, wherein said L-shape metal arm comprises a first side arm perpendicular to said second radiating arm and a second side arm parallel to said second radiating arm.

12. The multi-band antenna assembly as claimed in claim 8, wherein said first antenna comprises a protrusion on said connecting element connect with an inner conductor of a feed line, and said second antenna comprises a protrusion on said high radiating portion to connect with the inner conductor of said feed line.

13. The multi-band antenna assembly as claimed in claim 1, wherein said second antenna comprises a first radiating portion whose free end is parallel to said main body of said grounding element of said second antenna and a second radiating portion extending from said free end of said first radiating portion in a vertical direction to said first radiating portion, and said second radiating portion comprises a plurality of metal patches connecting with one another through some folded portions.

14. The multi-band antenna as claimed in claim 1, wherein said first antenna has the same structure as that of said second antenna.

15. The multi-band antenna assembly as claimed in claim 1, wherein said first antenna has the structures different from that of said second antenna.

* * * * *